United States Patent [19]

Kurihara et al.

[11] 4,365,550

[45] Dec. 28, 1982

[54] PRINTING MECHANISM FOR DOT MATRIX PRINTERS

[75] Inventors: Toshio Kurihara; Nagao Mizutani, both of Tokorozawa, Japan

[73] Assignee: Citizen Watch Co., Ltd., Tokyo, Japan

[21] Appl. No.: 246,183

[22] Filed: Mar. 23, 1981

[30] Foreign Application Priority Data

Apr. 11, 1980 [JP] Japan ..... 55-47567

[51] Int. Cl.[3] ..... B41J 3/12

[52] U.S. Cl. ..... 101/93.04; 400/121

[58] Field of Search ..... 400/121; 101/93.04, 101/93.09

[56] References Cited

U.S. PATENT DOCUMENTS 3,884,148 5/1975 Bergeron ..... 400/130 X 4,263,847 4/1981 Kurihara et al. ..... 346/101 X

FOREIGN PATENT DOCUMENTS 55-2023 1/1980 Japan ..... 101/93.04

*Primary Examiner*—Paul T. Sewell

*Attorney, Agent, or Firm*—Birch, Stewart, Kolasch & Birch

[57] ABSTRACT

A cross point type dot matrix impact printer comprising a platen and a plurality of hammers arranged in the axial direction of the platen. The platen has a helix composed of a plurality of protrusions helically provided on the periphery thereof. The hammer has a hammer head which strikes each protrusion during the rotation of the platen for performing the dot matrix impact printing.

7 Claims, 7 Drawing Figures

PRINTING MECHANISM FOR DOT MATRIX PRINTERS

BACKGROUND OF THE INVENTION

The present invention relates to a printing mechanism for a dot matrix printer, and more particularly to a printer comprising a platen having a plurality of protrusions helically provided on the periphery of the platen, and a plurality of hammers arranged in the axial direction of the platen, each of the hammers has a hammer head which is provided to cross protrusions, which is called a cross point type dot matrix printer.

Generally, the dot matrix impact printer is compact and economical and produces a clear print on a recording paper. The cross point type dot matrix impact printer is a more compact and economical printer. Generally, the cross point type dot matrix impact printer has a platen having a helical projection, a plurality of hammers arranged in the axial direction of the platen to cross the helical projection. The hammer strikes the helical projection interposing the recording paper, so that dot matrix printing is performed. The form of the printed dot is a small square made by a crossing area of the helical projection of the platen and the hammer head.

In such a dot matrix printer, the distance between the surface of the helical projection and the surface of the hammer head at the circumferentially opposite end portion of the crossing area is larger than the distance at a central portion of the crossing area, since the surface of the helical projection is circularly curved. Therefore, the printed dot is unclear at circumferentially opposite end portions. As a result, letters and figures composed by such dots are illegible.

SUMMARY OF THE INVENTION

It is an object of the present invention to provide a dot matrix printer which is compact and economical and may make a clear print.

According to the present invention, there is provided a printing mechanism for dot matrix printers comprising a platen, a plurality of protrusions helically provided on the periphery of said platen, a plurality of hammers arranged in the axial direction of said platen, each of said hammers having a hammer head which is provided to engage with the top of said protrusion, means for feeding ink to the periphery of said helical protrusion, means for rotating said platen, means for moving said hammers to said platen to perform the dot matrix printing.

These and other objects and features of the present invention will become more fully apparent from the following description with reference to the accompanying drawings.

DESCRIPTION OF THE PREFERRED EMBODIMENTS

Figure 1:
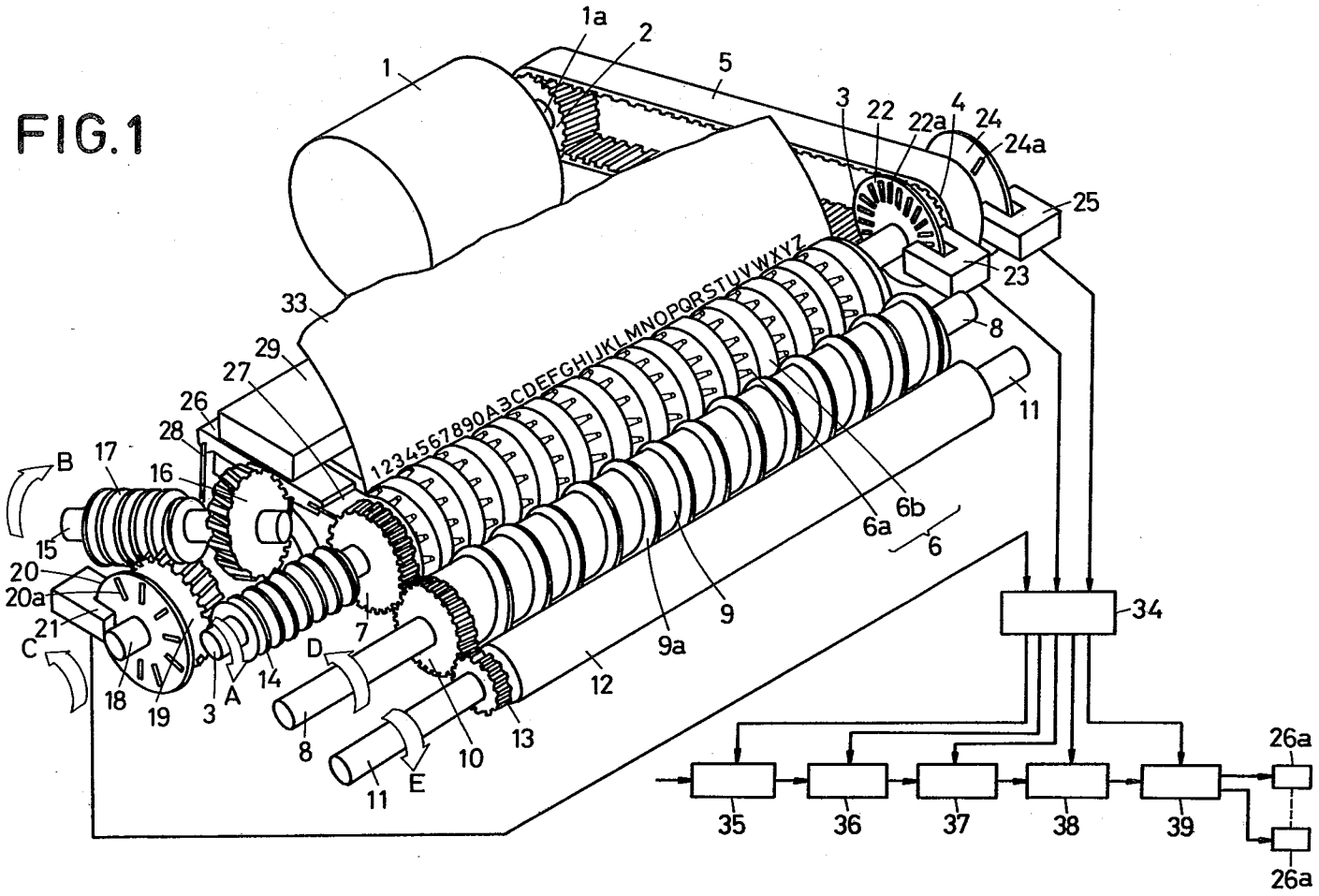
FIG. 1 is a perspective view showing a first embodiment of a dot matrix printer according to the present invention.
Figure 2:
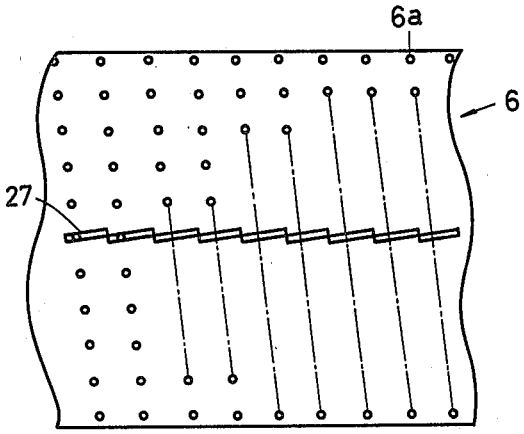
FIG. 2 is a developed plan view of a platen of FIG. 1.

Referring to FIGS. 1 to 4, numeral 1 designates a motor of which rotary shaft 1*a* has a pulley 2 secured thereto. The pulley 2 is connected to a pulley 4 of a platen shaft 3 by a belt 5. The platen shaft 3 is rotatably supported on a frame (not shown) of the printer. A platen 6 is secured to the platen shaft 3. As shown in FIG. 2, the platen 6 comprises a plurality of cylindrical protrusions 6*a* helically provided on the periphery thereof and a separating member 6*b* in the helical groove formed by protrusions 6*a*. Each of protrusions 6*a* has a round top surface. Protrusions 6*a* have the same diameter. The separating member 6*b* is made of elastic material such as rubber, steel plate and various sundry plastics. The periphery of the separating member 6*b* is slightly higher than that of the protrusion 6*a*. As described hereinafter, the member 6*b* acts to separate a recording paper 33 from protrusions 6*a* of the platen 6. A platen gear 7 is secured to the platen shaft 3. Secured to a transferring roller shaft 8 is a transferring roller 9 having a helical projection 9*a*. The platen 6 and the transferring roller 9 are adapted to touch each other at the peripheries of helical projections. The helical projection 9*a* is the same as the helix of protrusions 6*a* in peripheral diameter and pitch, but the lead angle of the helix is reversed. A transferring roller gear 10 secured to the transferring roller shaft 8 is engaged with the platen gear 7. An ink roller 12 secured to a ink roller shaft 11 is made of sponge rubber, sintering metal or plastic and touches the periphery of the helical projection 9*a*. The ink roller 12 contains black ink.

The ink transferring roller 9 is rotated through the gear 10 engaged with the gear 7 of the platen 6 at the same speed as the platen and the ink roller 12 is rotated through a gear 13 engaged with the gear 10.

Secured to the other end of the platen shaft 3 is a first worm 14 which is engaged with a first worm wheel 16 fixedly mounted on a shaft 15 rotatably supported on the frame. A second worm 17 provided on the shaft 15 engages with a second worm wheel 19 secured to a feed roller shaft 18 rotatably mounted on the printer frame. These gear assemblies are so arranged that when the platen shaft 3 rotates in the direction of arrow "A", the shafts 15 and 18 rotate in the direction of arrow "B" and "C", respectively.

Secured to the feed roller shaft 18 is a first timing disk 20 having ten radial slits 20*a* spaced equidistance. A first timing sensor 21 is provided on the frame adjacent the first timing disk 20. The first timing sensor 21 has a light emitting element disposed on one side of the disk 20 and a light receiving element disposed on the opposite side of the disk for producing an electrical signal upon receiving the light from the light emitting element passing through one of slits 20*a*. A second timing disk 22 having twenty-one slits 22*a* is secured to the platen shaft 3 and a second timing sensor 23 similar to the first timing sensor 21 is provided adjacent the second timing disk. Further, a third timing disk 24 having one slit 24*a* is secured to the platen shaft 3 and a third timing sensor 25 is also provided in connection with the third timing disk.

Figure 4:
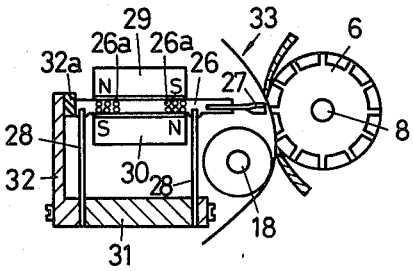
FIG. 4 is a sectional side view of the printer.

A plurality of hammers 26 are disposed adjacent the platen 6 arranged in the axial direction of the platen with a pitch equal to that of the helical protrusion 6a of the platen 6. Each hammer is made of plastic and has a driving coil 26a embeded therein as shown in FIG. 4.

Figure 3:
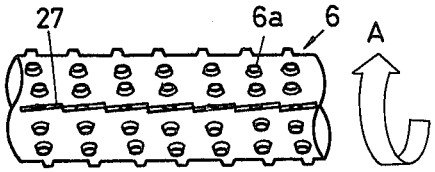
FIG. 3 shows the relationship between the platen and hammers.

The hammer has a hammer head 27 in the shape of a plate which has a linear impact face and is disposed to cross the projection 6a. The hammer head 27 has a width nearly equal to the pitch of the helical projection and is slightly tilted relative to the axial line of the platen as shown in FIG. 3. Each hammer 26 is supported by a pair of resilient plates 28 secured to a frame 31 so that the hammer may be moved to the platen 6 without deflecting. In the home position, the hammer is pressed against a stopper 32a provided on a frame 32. A pair of magnets 29, and 30 are disposed on opposite sides of the hammer array. Both magnets are inverted with each other in polarity. The driving coil 26a and the magnets 29 and 30 are so arranged that the hammer 26 is moved to the platen 6 by energization of the driving coil.

In operation, the platen 6 is rotated by the motor 1 through the belt 5 in the direction of the arrow "A" in FIG. 1. The transferring roller 9 is rotated through the gear 10 engaged with the gear 7 of the platen at the same speed as the platen 6.

The ink roller 12 is rotated through the gear 13 engaged with the gear 10 in the direction of the arrow "E". The ink roller 12 is touched to the periphery of the helical projection 9a so that ink contained in the ink roller 12 moves to the periphery thereof by the centrifugal force and transferred to the periphery of the helical projection 9a. Since the periphery of the helical projection 9a is continuously touched to the protrusions 6a, the ink is transferred to the protrusions 6a. However, since the recording paper 33 is separated from the projections 6a by the separating member 6b, the paper 33 is not stained with the ink.

In an example, the feed roller shaft 18 is rotated at the rate of one revolution per 110 revolutions of the platen 6 to feed the recording paper 33. During the rotation of the feed roller shaft 18, the first timing sensor 21 produces one timing signal every 36 degrees rotation of the shaft 18. The second timing sensor 23 generates one timing signal every 120/7 degrees revolution of the platen 6 and the third timing sensor 25 generates one timing signal per one revolution of the platen. By the first timing signal from the sensor 21 and the third timing signal from the sensor 25, position of the printing row on the recording paper 33 may be informed. Further, the position of the crossing point of the helix of protrusions 6a and the hammer head 27, that is, the position of the printed dot, may be informed by the three kinds of signals. Thus, by controlling the energization of the driving coil 26a of each hammer according to the timing signals, a desired character may be printed by the dot matrix, for example by dots arranged in the matrix comprising 5 columns and 7 rows.

Explaning an example of the control means, timing signals from three timing sensors 21, 23 and 25 are applied to a sequence circuit 34. The sequence circuit is adapted to control an interface 35, a register 36, a print signal generator 37, a buffer 38, and solenoid driver 39. The interface 35 is, for example connected to a computer, the register 36 memorizes the output of the interface and the print signal generator 37 is adapted to convert the output of the register 36 to a print signal at every row of the matrix and to apply the signal to the solenoid driver 39 through the buffer 38. Thus, the solenoid driver 39 acts to energize the driving coils 26a in accordance with the print signal from the print signal generator 37, so that dot matrix printing is performed.

Since the recording paper 33 is continuously fed, the hammer head 27 is slightly tilted relative to the axial line of the platen. However, if the paper is fed intermittently in synchronism with the printing, the hammer head is arranged in the axial direction.

Although the protrusion 6a has a round top surface, another shape such as square may be employed for the top surface.

Figure 5:
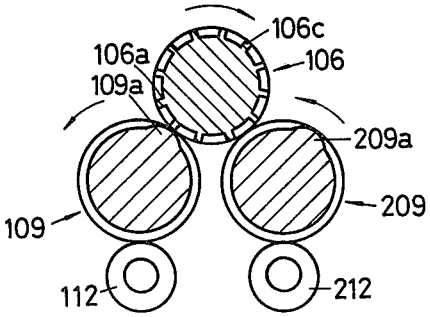
FIG. 5 is a sectional side view showing a part of a second embodiment of the present invention.
Figure 6:
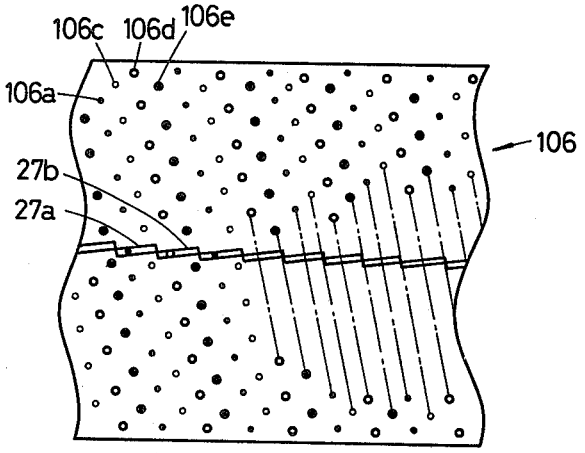
FIG. 6 is a developed plan view of a platen of FIG. 5.

Referring to FIGS. 5 and 6, this embodiment is for two-color printing. The printer comprises a platen 106 having four kinds of cylindrical protrusions 106a, 106c, 106d and 106e, a pair of ink transferring rollers 109 and 209, a first ink roller 112 containing black ink and a second ink roller 212 containing red ink. The platen 106 has a separating member (not shown) like the previous embodiment. A plurality of first small protrusions 106a having a small top surface area, second small protrusions 106c, third large protrusions 106d having a large top surface area, and fourth large protrusions 106e are helically provided on the platen 106. These adjacent helixes of protrusions are spaced ¼ pitch of helix apart from one another in the axial direction. On the other hand, protrusions of adjacent helixes are disposed with a phase difference of ½ pitch of the protrusion arrangement. The first transferring roller 109 has a helical projection 109a which engages with first protrusions 106a and fourth protrusions 106e and with the first ink roller 112. The second transferring roller 209 has a helical projection 209a which engages with the second protrusions 106c and third protrusions 106d and with the second ink roller 212.

In operation, the platen 106 and the first transferring roller 109 and the first ink roller 112 are rotated in the counter-direction to the adjacent one, and at the same time the second transferring roller 209 and the second ink roller 212 are rotated. Thus, black ink contained in the first ink roller 112 is transferred to the small protrusions 106a and the large protrusions 106e of the platen 106 through the helical projection 109a of the first transferring roller 109. On the other hand, red ink contained in the second ink roller 212 is transferred to the small protrusions 106c and the large protrusions 106d of the platen 106 through the helical projection 209a of the second transferring roller 209.

In an example, as shown in FIG. 6, when the hammer head 27a strikes the small protrusion 106a through the paper 33, the black ink on the small protrusion 106a is transferred to the paper 33 to make a print. When the hammer head 27b strikes the large protrusion 106d through the paper 33, the red ink on the large protrusion 106d is transferred to the paper 33 to make a print.

Further, the platen 106 is rotated and when the hammer head 27a strikes the small protrusion 106c through the paper 33 at a corresponding position thereto, a small red dot is printed on the paper. When the hammer head 27a strikes the large protrusion 106d, a large red dot is printed on the paper. When the hammer head 27a strikes the large protrusion 106e, a large black dot is printed on the paper.

Thus, by controlling each hammer according to the timing signal, a desired character may be printed by the dot matrix.

Figure 7:
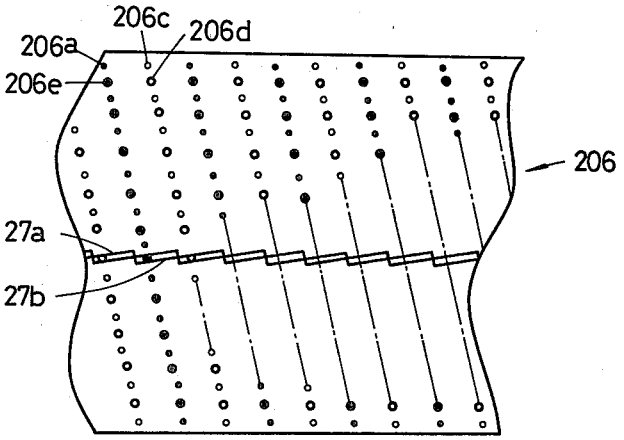
FIG. 7 is a developed plan view showing a platen of a third embodiment.

Referring to FIG. 7, this embodiment is also for two-color printing. The printer comprises a platen 206 having different kinds of protrusions, 206*a*, 206*c*, 206*d* and 206*e*, a pair of ink transferring rollers (not shown), and a pair of ink rollers (not shown). A plurality of first small protrusions 206*a* and fourth large protrusions 206*e* are alternately disposed on a helical line. Also, a plurality of second small protrusions 206*c* and third large protrusions 206*d* are alternately disposed on the platen. Both helixes are disposed with ½ helical pitch difference. That is, as shown in FIG. 7, the platen has two kinds of helical lines, one of which comprising a plurality of first protrusions 206*a* and the fourth protrusions 206*e*, and the other comprising a plurality of second protrusions 206*c* and the third protrusions 206*d*.

In operation, the platen 206, first transferring roller and first ink roller are rotated, at the same time the second transferring roller and second ink roller are rotated. Thus, black ink contained in the first ink roller is transferred to small protrusions 206*a* and large protrusions 206*e* of the platen 206 through the first transferring roller. Red ink contained in the second ink roller is transferred to the small protrusions 206*c* and the large protrusions 206*d* of the platen 206 through the second transferring roller.

In an example, as shown in FIG. 7, when the hammer head 27*a* strikes the large protrusion 206*d* through the paper 33, the red ink on the large protrusion 206*d* is transferred to the paper 33 to make a print. When the hammer head 27*b* strikes the large protrusion 206*e* through the paper 33, the black ink on the large protrusion 206*e* is transferred to the paper 33 to make a print. Further, the platen 206 is rotated and when the hammer head 27*a* strikes the small protrusion 206*c* at a corresponding position thereto, a small red dot is printed on the paper. When the hammer head 27*a* strikes the large protrusion 206*e* a large black dot is printed on the paper. When the hammer head 27*a* strikes the small protrusion 206*a*, a small black dot is printed on the paper.

Thus, in the same manner as the second embodiment, by controlling each hammer according to the timing signal, a desired character may be printed by the dot matrix.

From the foregoing it will be understood that the present invention provides a dot matrix printer which may make a clear print since the impact printing is made by a plane contact. Further, it is possible to make a print having a shading with a printer provided with various kinds of protrusions which are different in area of the surface.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A printing mechanism for dot matrix printers comprising a platen, a plurality of cylindrical protrusions helically provided on the periphery of said platen, said protrusions comprising at least two groups which are different in round top surface area, a plurality of hammers arranged in the axial direction of said platen, each of said hammers being supported so as to be moved to said platen and having a hammer head which has an axial length substantially equal to the pitch of helix of said protrusions so as to engage with the tops of said protrusions during rotation of said platen, means for feeding ink to periphery of said helical protrusions, means for rotating said platen, and means for moving said hammers to said platen to engage said protrusions to perform the dot matrix printing.

2. A printing mechanism for dot matrix printers according to claim 1 further comprising a helical separating member made of resilient material provided on the periphery of said platen.

3. A printing mechanism for dot matrix printers according to claim 1 in which said plurality of protrusions are disposed on at least one helical line provided on the periphery of said platen.

4. A printing mechanism for dot matrix printers according to claim 1 in which said plurality of protrusions are disposed on a plurality of helical lines provided on the periphery of said platen.

5. A printing mechanism for dot matrix printers according to claim 4 in which each protrusion on one of said helical lines has a top surface area different from that of the protrusions on an adjacent helical line.

6. A printing mechanism for dot matrix printers according to claim 4 in which said protrusions on at least one of said helical lines have different top surface areas.

7. A printing mechanism for dot matrix printers according to claim 4 in which said means for feeding ink is adapted to separately feed different inks to said protrusions.

* * * * *